US005104343A

United States Patent [19]

Muragishi et al.

[11] Patent Number: 5,104,343

[45] Date of Patent: Apr. 14, 1992

[54] METHOD FOR MANUFACTURING FLAT DISPLAY DEVICE

[75] Inventors: Isao Muragishi, Osaka; Takashi Suzuki, Toyonaka; Takashi Kanehisa, Osaka; Mitsunori Yokomakura, Takatsuki; Tetsuo Hori, Kawachinagano, all of Japan

[73] Assignee: Matsushita Electric Industrial Co., Ltd., Osaka, Japan

[21] Appl. No.: 603,020

[22] Filed: Oct. 26, 1990

[30] Foreign Application Priority Data

Oct. 26, 1989 [JP] Japan ..... 1-279354

[51] Int. Cl.[5] ..... H01J 9/26; H01J 9/18

[52] U.S. Cl. ..... 445/25; 445/24

[58] Field of Search ..... 445/24, 25, 33, 34, 445/37; 228/159

[56] References Cited

U.S. PATENT DOCUMENTS

| | | | |
|---|---|---|---|
| 1,547,812 | 7/1925 | Hendry | 445/33 |
| 2,297,492 | 9/1942 | Michaelis | 445/33 |
| 4,263,700 | 4/1981 | Fujisaki et al. | 445/25 |
| 4,407,934 | 10/1983 | Kuchinsky et al. | 445/37 |

FOREIGN PATENT DOCUMENTS

| | | | |
|---|---|---|---|
| 0037378 | 4/1978 | Japan | 445/25 |

*Primary Examiner*—Kurt Rowan
*Assistant Examiner*—Jeffrey T. Knapp
*Attorney, Agent, or Firm*—Wenderoth, Lind & Ponack

[57] ABSTRACT

A method is disclosed for manufacturing a flat display device including line cathodes arranged at regular intervals, a plurality of flat electrodes arranged so as to be spaced apart by a predetermined distance from one another to control line electron beams generated from the cathodes, and a fluorescent substance which emits a light as a result of a collision of the electron beam. The method includes the steps of: arranging a bar-shaped low-melting glass at a connecting position where the beam generated from the cathode does not pass through; positioning the electrodes and the glass against each other when the electrodes are fixed to connect to the glass; fixing initial connecting portions of the electrodes to the glass, each of which is located outside an outer frame of each electrode; heating and fusing the glass to connect it to the electrodes; and removing the initial connecting portions of the electrodes arranged outside the outer frames of the electrodes from the electrodes.

4 Claims, 3 Drawing Sheets

METHOD FOR MANUFACTURING FLAT DISPLAY DEVICE

BACKGROUND OF THE INVENTION

The present invention relates to a method for manufacturing a flat display device for use in a video apparatus.

Recently, flat panel display devices capable of displaying a color television image by use of electron beams have been developed. In one example of the devices, an image plane thereof is divided into a plurality of sections in a vertical direction thereof so that each section vertically deflects electron beams to display a plurality of lines, while the image plane thereof is divided into a plurality of sections in a horizontal direction thereof so that red, green, and blue fluorescent substances emit lights sequentially in each section. Thus, the exposure amount of the electron beams to the red, green, and blue fluorescent substances is controlled by a color picture signal to display a television picture as a whole.

The above-described conventional flat display device is described in detail with reference to the drawings.

As shown in FIG. 3, in the device, a back plate 1, a line cathode 2 serving as an electron beam source, a beam leading electrode 3, a signal electrode 4, a horizontal focusing electrode 5, a horizontal deflection electrode 6, a vertical deflection electrode 7, and a screen 8 are arranged from the rear to the front of the device in order. These above components are accommodated in a vacuum glass container. In the device, electron beams 100 generated from the cathode 2 serving as an electron beam source are controlled by the beam leading electrode 3, the signal electrode 4, the horizontal focusing electrode 5, and the horizontal deflection electrode 6 to expose the red, green, and blue fluorescent substances on the screen 8 for image display.

According to the device, each of the beam leading electrode 3, the signal electrode 4, the horizontal focusing electrode 5, the horizontal deflection electrode 6, and the vertical deflection electrode 7 is comprised of a flat panel electrode. Then, a spacer having a surface made of insulating material is inserted between the adjacent components and is adhesively fixed to the components with low-melting adhesive glasses coated on the surfaces of the spacer. Thus, each component is accurately spaced between adjacent components at predetermined intervals so that the adjacent components are electrically insulated from each other.

FIG. 4 shows the conventional method for fixing with the glass. In FIG. 4, a spacer 11 having the surface made of insulating material is inserted between flat panel electrodes 5 and 6 and a low-melting adhesive glass 12 is coated on the surface of the spacer 11. Reference numeral 17 denotes a fan. The electrodes 5 and 6 and the spacer 11 are positioned onto a fired substrate 13 by positioning pins 14 standing on the fired substrate 13. Then, the electrodes 5 and 6 are heated to the fusing temperature of the adhesive glass 12 within a firing environment oven 16 in order to be adhesively fixed thereto while they are pressed by a stamper 15.

However, in order to position the electrodes 5 and 6 and the spacer 11 inserted between the electrodes 5 and 6 by the positioning pins 14 vertically standing on the fired substrate 13, the spacer 11 inserted therebetween must have a highly accurate hole into which the pin is inserted, resulting in a high manufacturing cost. Additionally, it is difficult to automate the manufacturing process because after the electrodes 5 and 6 and the spacer 11 are mounted onto the positioning pins 14 and adhesively fixed to each other, the pins must be removed therefrom.

SUMMARY OF THE INVENTION

Accordingly, an essential object of the present invention is to provide a method for manufacturing a flat display device which can be automated at lower cost.

In accomplishing these and other objects, according to one aspect of the present invention, there is provided a method for manufacturing a flat display device comprising line cathodes arranged at regular intervals, a plurality of flat electrodes arranged to be spaced apart by a predetermined distance from one another to control line electron beams generated from the cathodes, and a fluorescent substance which emits a light as a result of a collision of the electron beam. The method comprises the steps of: arranging a bar-shaped low-melting glass at a connecting position where the beam generated from the cathode does not pass through; positioning the electrodes and the glass relative to each other when the electrodes are fixed to connect to the glass; fixing initial connecting portions of the electrodes to the glass, each of which is located outside an outer frame of each electrode; heating and fusing the glass to connect it to the electrodes; and removing the initial connecting portions of the electrodes arranged outside the outer frames of the electrodes from the electrodes.

By the above construction method of the present invention, when the plural flat electrodes are adhesively fixed, the electrodes are previously positioned and the initial connecting portions of the electrodes arranged outside the outer frames of the electrodes are fixed to the glass so that the electrodes are temporarily fixed thereto. Thereafter, the bar-shaped low-melting glass is heated and fused to adhesively fix the electrodes to the glass and then the initial connecting portions of the electrodes are removed therefrom. Therefore, the method for manufacturing a flat display device can facilitate lower-cost automation.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE EMBODIMENTS

Figure 1:
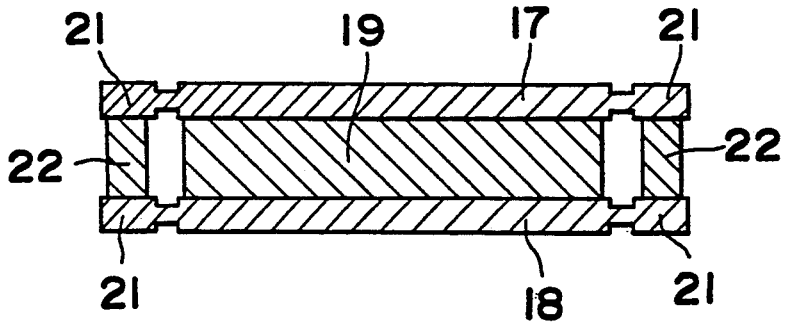
FIG. 1 is a cross-sectional view of an apparatus for use in a case where flat electrodes are temporarily fixed to a glass in a method for manufacturing a flat display device according to one embodiment of the present invention.

Before the description of the present invention proceeds, it is to be noted that like parts are designated by like reference numerals throughout the accompanying drawings.

FIG. 1 is a cross-sectional view of an apparatus for use in a case where flat electrodes are temporarily fixed to a glass in a method for manufacturing a flat display device according to one embodiment of the present invention.

In FIG. 1, reference numerals 17 and 18 denote flat panel electrodes and reference numeral 19 denotes a bar-shaped low-melting glass. The glass 19 is arranged at a portion, where an electron beam 100 does not pass through between the electrodes 17 and 18, such as a frame portion around a beam hole. Reference numeral 21 denotes an initial connecting portion arranged at the outer frame portion of each of the electrodes 17 and 18, and reference numeral 22 denotes a spacer chip made of metal with the same thickness as a predetermined distance between the electrodes 17 and 18.

In this embodiment, after the positioning of the electrodes 17 and 18 is completed, they are temporarily fixed with the initial connecting portions 21 thereof through the spacer chips 22. The temporary fixing is performed by a laser welding.

Figure 2:
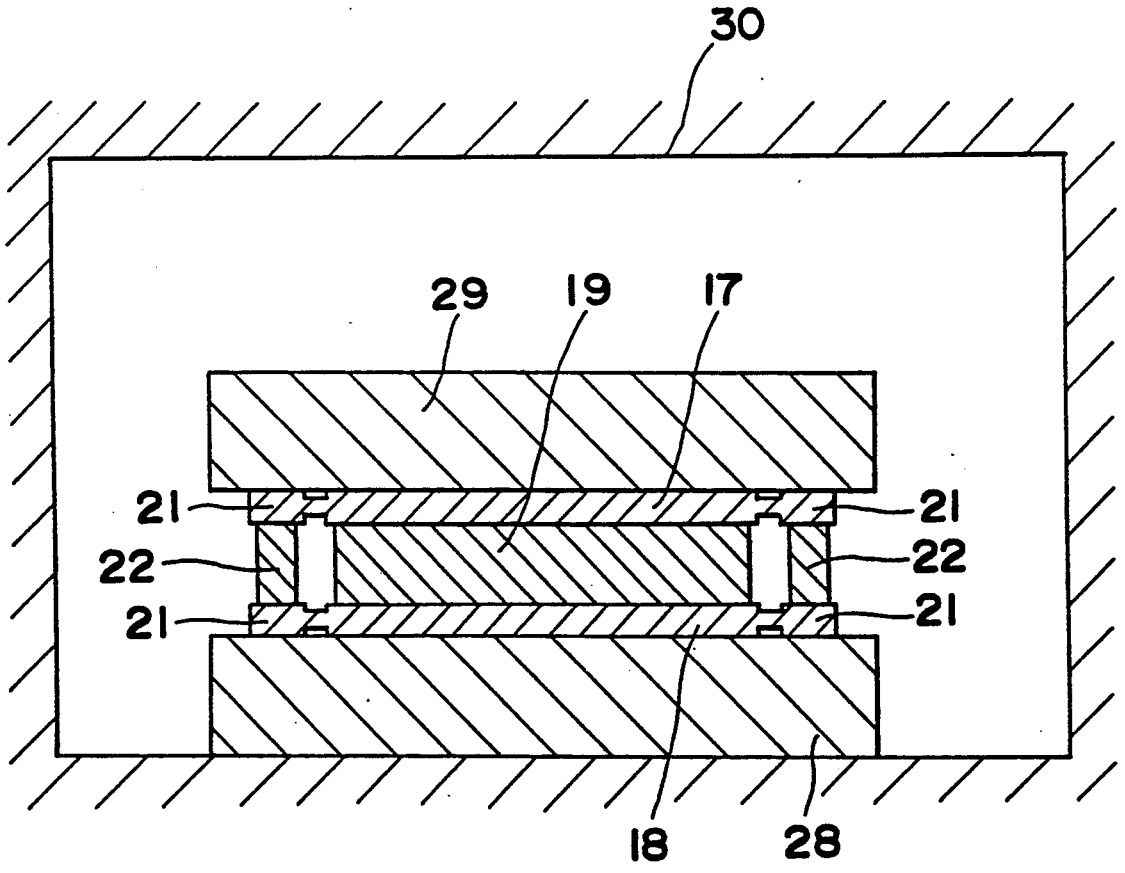
FIG. 2 is a cross-sectional view of an apparatus for use in a case where the flat electrodes are adhesively fixed to the glass in the method for manufacturing the flat display device according to the embodiment of the present invention.
Figure 3:
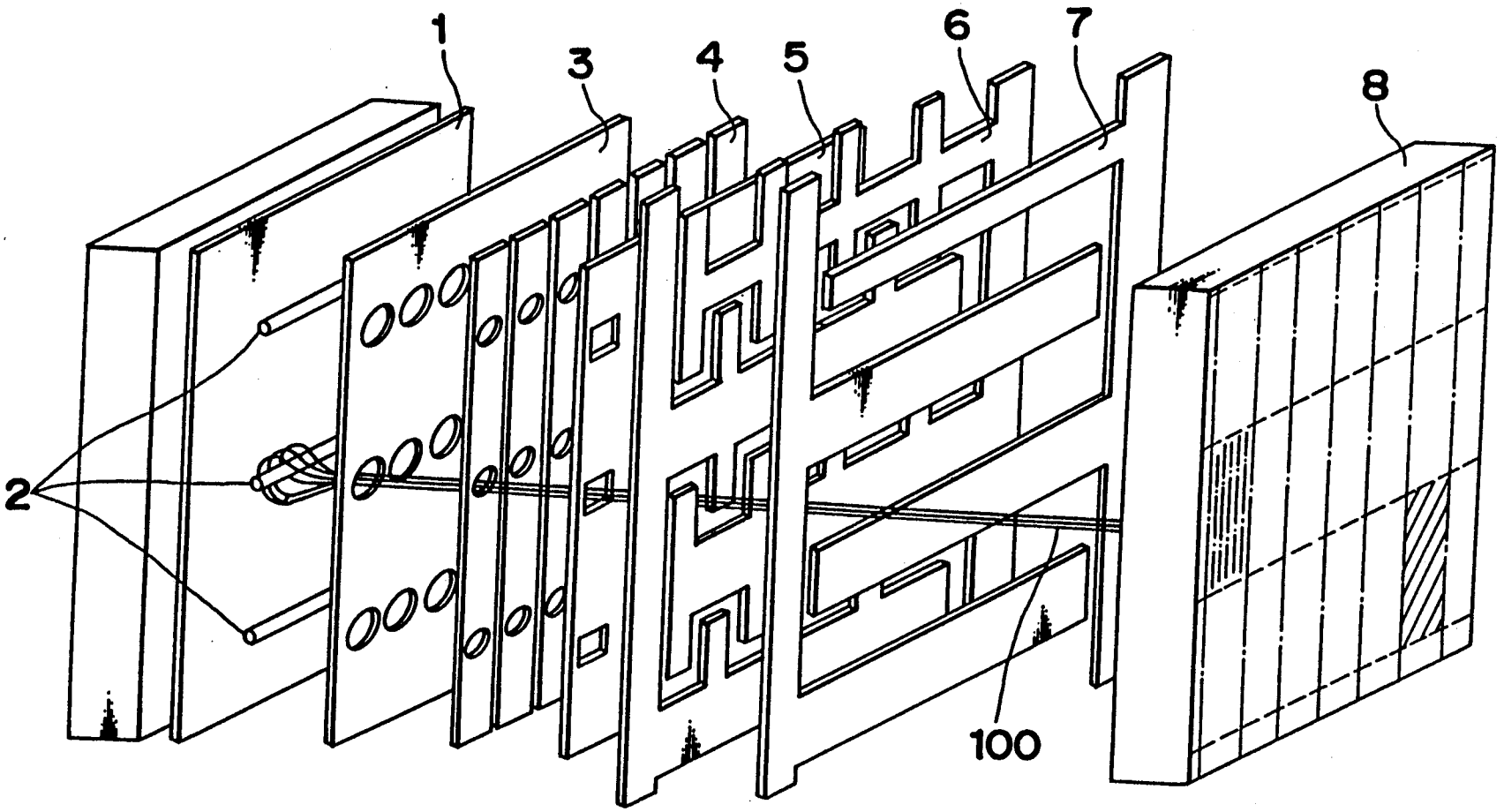
Fig. 3 PRIOR ART
FIG. 3 is a partial exploded perspective view of a conventional flat display device.
Figure 4:
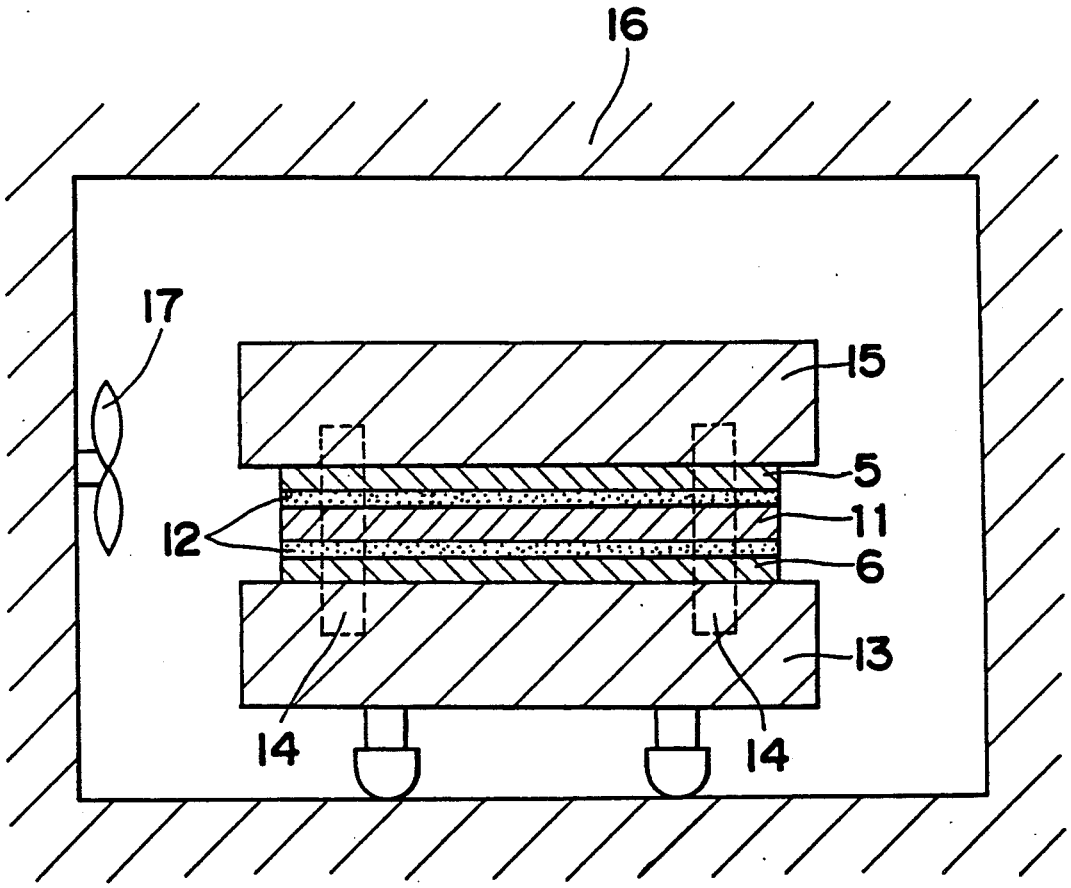
Fig. 4 PRIOR ART
FIG. 4 is a cross-sectional view of an apparatus for use in a conventional method in which flat electrodes are adhesively fixed to a spacer.

FIG. 2 is a cross-sectional view of an apparatus for use in a case where the flat electrodes 17 and 18 are adhesively fixed to the glass 19 in the method for manufacturing the flat display device according to the embodiment of the present invention.

The electrodes 17 and 18 and the glass 19 are pressed between a fired substrate 28 and a stamper 29. Then, they are heated to the working temperature of the glass 19 within a firing environment oven 30 until the completion of the adhesive fixing between the glass 19 and the electrodes 17 and 18. In the embodiment, the electrodes 17 and 18 and the glass 19 are heated so that the temperature in the firing environment oven 30 rises at a rate of 3°-7° C. per minute and thereafter they are left at 480° C. for 5-15 minutes within the firing environment oven 30, and then they are cooled, resulting in strongly adhesive fixing with high accuracy. After the completion of the adhesive fixing, the initial connecting portions 21 arranged at the outer frame portions of the electrodes 17 and 18 are removed from the electrodes 17 and 18 by cutting with a pressing machine. The removing operation can be performed by other methods.

Although the electrodes 17 and 18 and the glass 19 are uniformly heated within the firing environment oven 30 in the embodiment, they can be uniformly heated to the working temperature of the glass 19 with other methods such as the use of heating plates in order to perform the adhesive fixing with high productivity.

Additionally, although the laser welding is used for the step of fixing in the embodiment, a resistance welding can be used in the step of temporarily fixing with high accuracy.

According to the embodiment, when the plural flat electrodes are adhesively fixed, the electrodes are previously positioned and the initial connecting portions of the electrodes arranged outside the outer frames of the electrodes are fixed to the glass so that the electrodes are temporarily fixed thereto. Thereafter, the bar-shaped low-melting glass is heated and fused to adhesively fix the electrodes to the glass and then the initial connecting portions of the electrodes are removed therefrom. Therefore, the method for manufacturing a flat display device can facilitate lower-cost automation.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for manufacturing a flat display device comprising line cathodes arranged at regular intervals, a plurality of flat electrodes arranged a predetermined distance apart from one another for controlling line election beams generated by the cathodes, and a fluorescent substance which emits light as a result of collisions therewith by the electron beams, said method comprising the steps of:

fixing an initial connecting portion to an outer periphery of each of the plurality of flat electrodes such that said connecting portion extends outwardly from said outer periphery;

arranging a low-melting glass member between adjacent ones of the plurality of flat electrodes at a position where the beams generated by the cathodes do not pass through;

arranging a metal spacer between the initial connecting portions which are fixed to said adjacent ones of the plurality of flat electrodes;

fixing said metal spacer to each of the initial connecting portions fixed to said adjacent ones of the plurality of flat electrodes;

heating said low-melting glass member to cause it to fuse to said adjacent ones of the plurality of flat electrodes; and removing the initial connecting portions fixed to said adjacent ones of the plurality of flat electrodes, along with the metal spacer.

2. A method as recited in claim 1, wherein said step of arranging a low-melting glass member between adjacent ones of the plurality of flat electrodes comprises arranging a bar-shaped low-melting glass member between said adjacent ones of the plurality of flat electrodes.

3. A method as recited in claim 2, wherein said step of fixing said metal spacer to each of the initial connecting portions fixed to said adjacent ones of the plurality of flat electrodes is performed with a laser beam.

4. A method as recited in claim 1, wherein said step of fixing said metal spacer to each of the initial connecting portions fixed to said adjacent ones of the plurality of flat electrodes is performed with a laser beam.

* * * * *